United States Patent [19]

Stoffregen

[11] Patent Number: 4,732,140

[45] Date of Patent: Mar. 22, 1988

[54] VIBRATORY MASSAGER RETAINED AGAINST BODY WITH BELT HAVING ELASTIC STRAP

[76] Inventor: Robert T. Stoffregen, 23 Woodrush Dr., Irvine, Calif. 92714

[21] Appl. No.: 897,613

[22] Filed: Aug. 18, 1986

[51] Int. Cl.[4] ..... A61H 11/00; A61H 1/00; A61H 23/02

[52] U.S. Cl. ..... 128/36; 128/32; 128/34

[58] Field of Search ..... 128/36, 32, 34, 35, 128/58, 63; 2/311, 312, 318, 319, 320, 321, 322

[56] References Cited

U.S. PATENT DOCUMENTS

| | | | |
|---|---|---|---|
| 2,347,554 | 4/1944 | Gothers | 128/36 |
| 2,523,547 | 9/1950 | Zerble | 128/36 |
| 2,703,571 | 3/1955 | Thomas | 128/36 |
| 2,830,313 | 4/1958 | Mountanos | 128/63 |
| 3,361,130 | 1/1968 | Rowe | 128/36 |
| 3,468,304 | 9/1969 | Teranishi | 128/36 |
| 3,557,781 | 1/1971 | Kaye | 128/36 |
| 3,613,673 | 10/1971 | La Hue | 128/36 |
| 3,672,355 | 6/1972 | Ogawa et al. | 128/36 |
| 3,812,848 | 5/1974 | Kollitz | 128/63 |
| 3,817,245 | 6/1974 | Kroeger | 2/319 |
| 3,841,321 | 10/1974 | Albach et al. | 128/36 |
| 3,885,250 | 6/1975 | Schiller | 2/321 |
| 3,896,795 | 7/1975 | Solhkhah | 128/36 |
| 3,996,929 | 12/1976 | Mabuchi | 128/52 |
| 4,055,169 | 10/1977 | Baker et al. | 128/36 |

*Primary Examiner*—Edgar S. Burr
*Assistant Examiner*—Tonya Lamb
*Attorney, Agent, or Firm*—Weissenberger & Peterson

[57] ABSTRACT

A vibratory massage device for use in conjunction with therapeutic exercises. The device has several belts of varying sizes, to which one or two vibrator units can be releasably attached for use on various body parts. An elastic band on each belt firmly presses the vibratory unit against the belt web when the belt is tightened, so as to prevent irritation-producing movement between the belt and the patient's skin. The motor of the vibratory unit is provided with a carrier bearing and eccentric-operated air flow means to permit miniaturization of the vibratory unit without loss of effectiveness.

15 Claims, 11 Drawing Figures

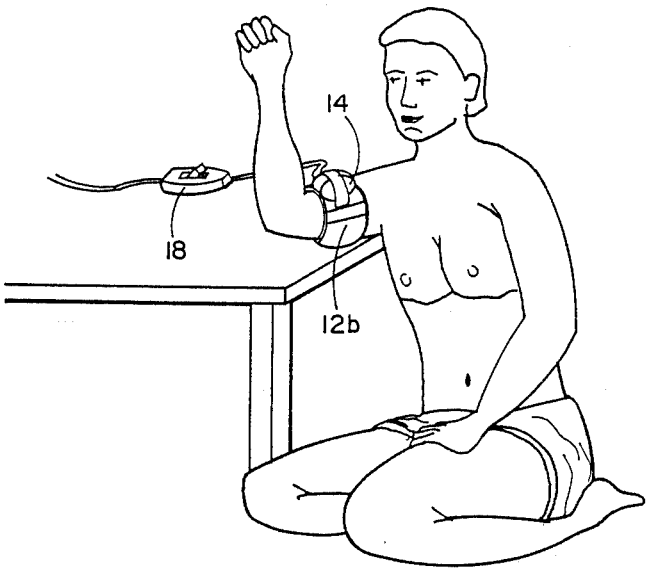
FIG. 1b
FIG. 1c
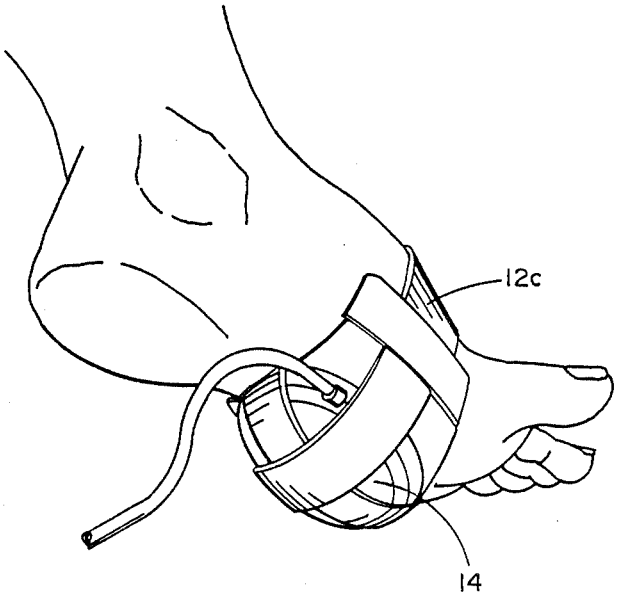

VIBRATORY MASSAGER RETAINED AGAINST BODY WITH BELT HAVING ELASTIC STRAP

FIELD OF THE INVENTION

This invention relates to vibratory massaging devices, and particularly to a versatile device which is adaptable for use on all parts of the body, and which produces intensive massage without skin irritation.

BACKGROUND OF THE INVENTION

Back pain sufferers often have a frequent need to relieve painful strain by exercising a variety of muscles while relaxing as much as possible. The therapeutic effect of such exercises is greatly increased and accelerated by simultaneous vigorous massage of the affected muscles.

Various vibratory devices have previously been proposed for massaging application to the body by means of a belt or harness. However, such devices have been unsatisfactory for the purpose described herein because they were not conveniently adaptable for use on various body parts, were difficult to control, were too weak for in-depth massage, and were apt to cause skin irritation.

SUMMARY OF THE INVENTION

The device of this invention overcomes the above-mentioned disadvantages by providing a pair of detachable vibratory units which can be used singly or together, in conjunction with a plurality of belts of various sizes which allow their effective application to any body part in need of treatment.

In one aspect of the invention, the belt is provided with an elastic band which cooperates with the inelastic but flexible web of the belt to firmly press a vibratory unit placed between them against the web, and thereby against the body, when the belt is secured around the body part being treated.

In a second aspect of the invention, the vibratory units are connected so as to be controllable by a single control accessible to the patient during use regardless of the location of the vibratory units on the body, and regardless of whether only one or both of the units are in use.

In a third aspect of the invention, the vibrating units are equipped with a carrier bearing to provide highly intense vibration without causing destructive stresses on the motor shaft. The vibration-producing eccentric also acts as a ventilator in the inventive device to cool the motor.

It is therefore the object of the invention to provide a versatile vibrating device for massaging purposes which minimizes skin irritation, yet allows deep massage, by pressing an intensely vibrating unit firmly against the body.

It is another object of the invention to provide a vibrating device conveniently usable on all body parts and in various environments by using vibrating units which are readily detachable from their supporting belt, are conveniently controllable during use regardless of their position on the body, and are readily adaptable for interchangeable use with various types of power sources.

It is still another object of the invention to provide an intensely vibrating vibrator unit of minimal size by providing a carrier bearing for the vibrator motor shaft, and by using the vibration-producing eccentric to cool the motor.

BRIEF DESCRIPTION OF THE DRAWINGS

FIG. 1*b* is a perspective view illustrating another use of the device of this invention;

FIG. 1*c* is a perspective view illustrating still another use of the device of this invention;

DESCRIPTION OF THE PREFERRED EMBODIMENT

Patients with spinal disorders are typically subject to periodic onslaughts of pain at widely varying locations of the body. For example, pain may appear at one time in the small of the back, at other times in the neck, upper arms, hands, thighs, calves, feet, or between or on the shoulders, for example.

It has been found that these attacks of pain can usually be relieved by relaxation and precise flexation of certain muscles by appropriate exercises or motions. This relief is greatly enhanced by properly located, deep vibratory massage of sufficient intensity to cause a mild temperature rise in the affected muscle tissue.

In order to allow convenient treatment of these diverse areas of the body, the present invention uses a pair of variable-speed vibrator units which are readily attachable to belts of various sizes, and which can be used singly or together under a common control.

Figure 1A:
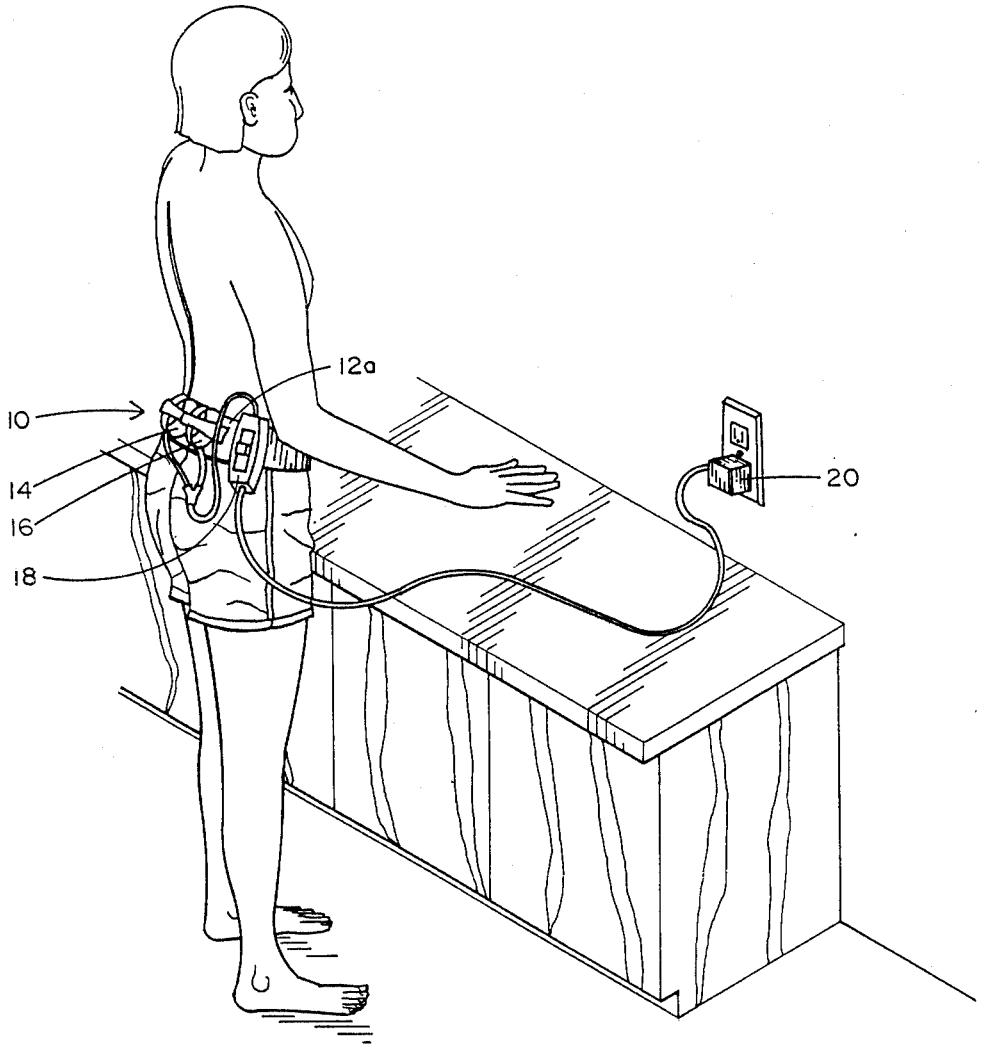
FIG. 1*a* is a perspective view illustrating one use of the device of this invention.

FIGS. 1*a* through 1*c* illustrate the use of the inventive device on various parts of the body. In FIG. 1*a*, the device 10 consists of a torso belt 12*a* supporting a pair of vibrating units 14, 16. The speed of the vibrating units can be controlled through the use of conventional electrical circuitry by a control 18 which remains within the reach of the patient during the operation of the vibratory units 14, 16 and which may conveniently be attached to the belt 12*a* by appropriate conventional means such as a belt clip (not shown).

In FIG. 1*a*, the power supply for the vibrator units 14, 16 is shown as an AC adapter 20 for use with commercial power. Preferably (for versatility as well as safety), the vibrator units 14, 16 are designed to use twelve-volt DC power. This allows their use with a cigarette lighter adapter in a vehicle, or with an appropriate connector from a twelve-volt battery pack.

FIG. 1*b* illustrates the use of a single vibratory unit 14 in conjunction with a limb belt 12*b* for treatment of the upper arm. FIG. 1*c* illustrates the use of a single vibratory unit 14 with a hand or foot belt 12*c* for treatment of the extremities.

Figure 2:
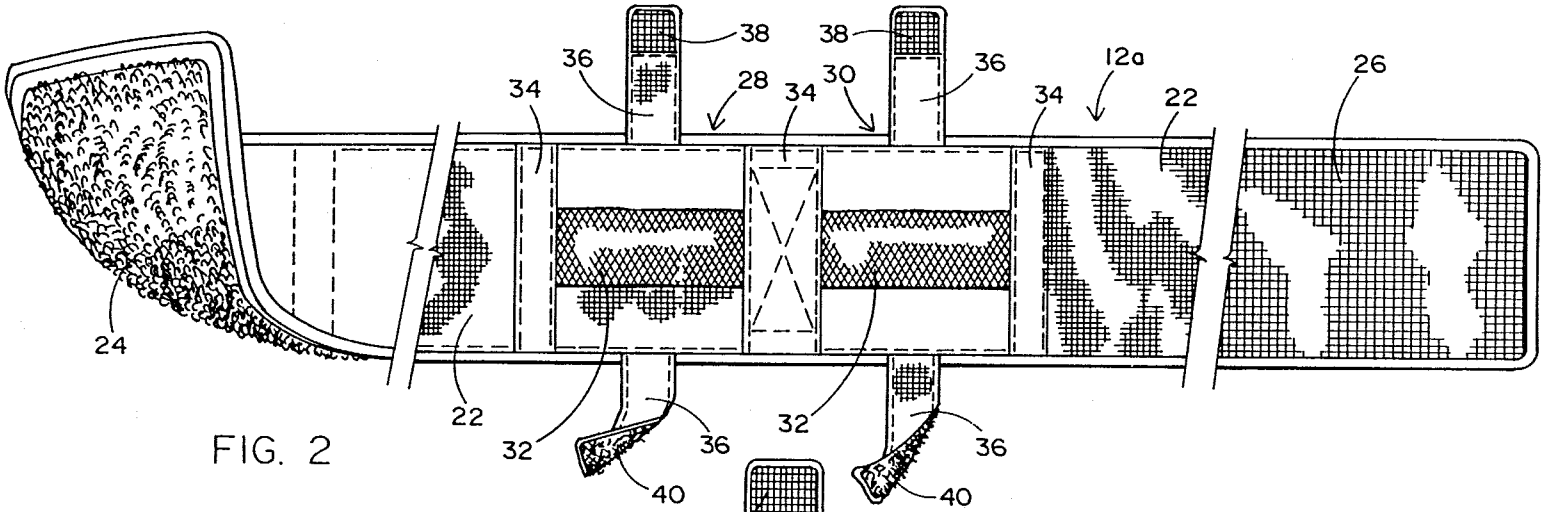
FIG. 2 is a plan view of a multiple-unit belt for the device of this invention.
Figure 3:
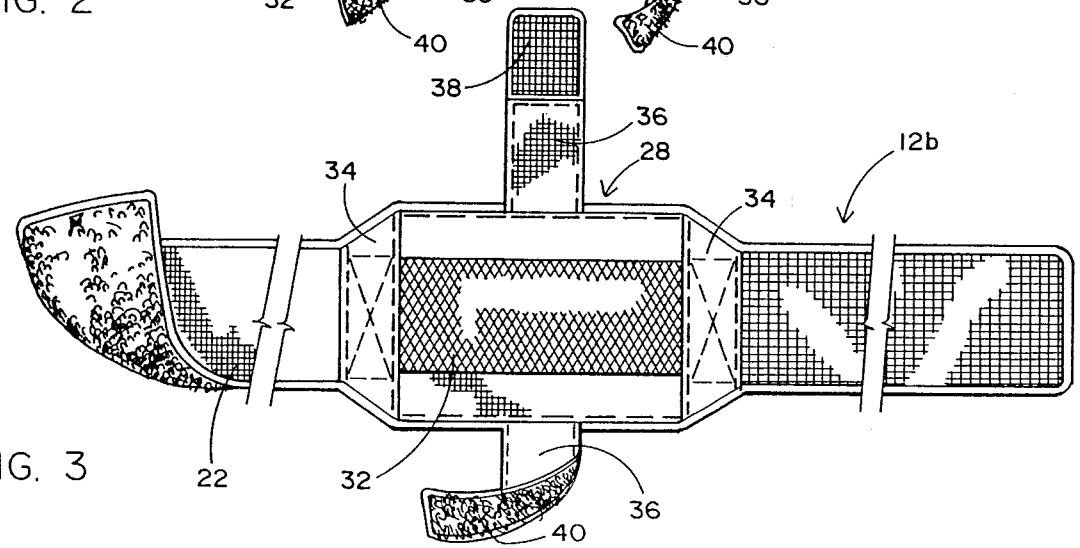
FIG. 3 is a plan view of a single-unit belt for the device of this invention.

FIGS. 2 and 3 shows the details, respectively, of the torso belt 12*a* and the limb belt 12*b*. In each instance, the belt 12*a* or 12*b* is formed of a web 22 of soft, flexible, yet inelastic cotton material interwoven in a manner similar to the weave of a seat belt.

The ends of the belt 12*a* or 12*b* are provided, respectively, with the loop portion 24 and the hook portion 26 of a Velcro strip which allows the belt to be tightly fastened around body parts of varying diameter. Tight fastening of the belt at any diameter is essential to the invention for a reason hereafter discussed.

At each of the vibrator positions (28, 30 in FIG. 2 and 28 in FIG. 3), an elastic band 32 is disposed longitudinally of the belt in its center. The longitudinal ends of the elastic bands 32 are anchored to the web 22 by crosspieces 34. Also anchored to the web 22 are retaining straps 36 whose outer ends are provided, respectively, with Velcro hook strips 38 and loop strips 40.

The foot belt 12*c* may be identical in construction to the limb belt 12*b*, except for a shorter web 22 to accommodate the shorter circumference of a hand or foot.

In the past, skin irritation has frequently been an undesirable side effect of the application of vibratory stimuli to the body. This irritation is usually the result of friction between the skin and the vibratory device when the vibratory device is sufficiently loose to move or creep with respect to the skin.

The present invention solves this problem by pressing the vibrating units 14, 16 firmly against the web 22, and thereby firmly pressing the web 22 against the patient's body. The soft cotton material of the web 22 engages the surfaces of the patient's skin with sufficient pressure, when the belt 12*a, b,* or *c* is in place, to prevent any movement of the web 22 relative to the skin during operation of the vibrator units 14, 16. Any movement or creep caused by the vibration occurs between the relatively slick surface of the vibrator unit 14 or 16 and the web 22.

Figure 4:
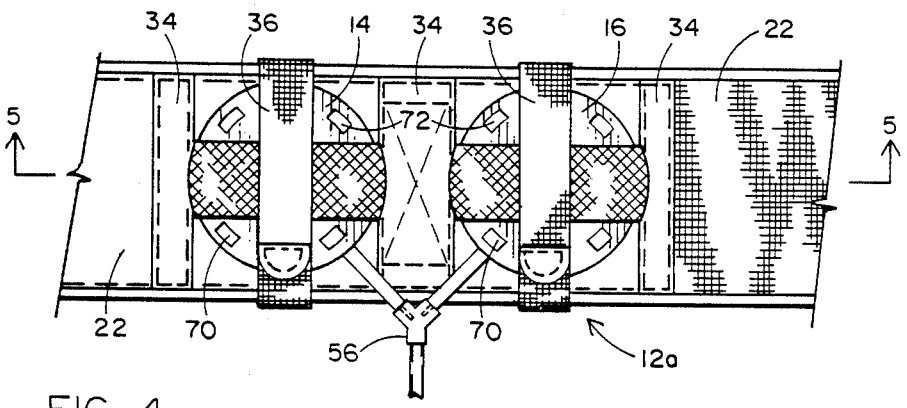
FIG. 4 is a plan view of the belt of FIG. 2 with the vibrating units inserted.
Figure 5:
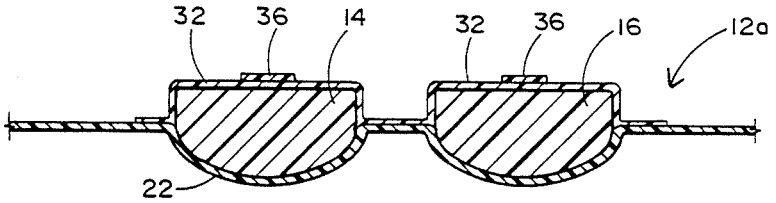
FIG. 5 is a section along line 5—5 of FIG. 4 prior to attachment of the belt to the body.
Figure 6:
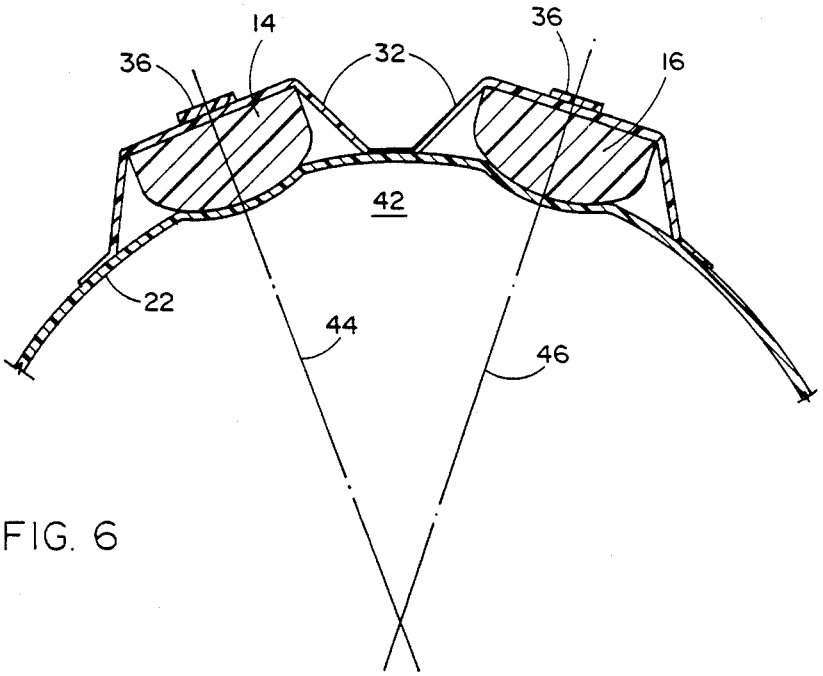
FIG. 6 is a section similar to FIG. 5 but showing the belt attached to the body.

The pressure necessary for this mode of operation of the inventive device is produced by the elastic bands 32, as best shown in FIGS. 4 through 6. When the vibrator units 14, 16 are inserted between the elastic bands 32 and the web 22, and are fastened in place with the retaining straps 36 as shown in FIG. 4, the belt 12*a* assumes the configuration shown in FIG. 5. In that configuration, the elastic bands 32 (whose unstressed length is substantially equal to the diameter of the vibrating units 14, 16) are essentially distended so that their length is substantially equal to the longitudinal dimension of the vibrating units (that part of the vibrating unit covered by the elastic band as illustrated in FIG. 5), and the substantially flexible but substantially inelastic web 22 is pulled around the sides of the vibrator units 14, 16 in such a manner as to prevent the vibrator units 14, 16 from moving longitudinally of the belt 12*a*.

When the belt 12*a* is now placed around the body of the patient and pulled tight, the web 22 lies generally flat against the patient's skin 42 except for deformation of the web 22 by the vibratory units 14, 16 in the manner illustrated in FIGS. 5 and 6 and the elastic bands 32 are stretched. The stretching of the bands 32 causes them to bias the vibrator units 14, 16 toward the skin 42 with sufficient force to firmly engage the web 22 with the skin 42 so as to prevent their relative movement.

It will be noted in FIG. 6 that the curvature of the patient's body causes the web 22 to exert a greater pull on the elastic bands 32 on the outside of the vibrator units 14, 16 than between them. This causes the axes 44, 46 of the vibrator units 14, 16 to become inclined toward each other, thereby focusing the vibrations at some depth inside the body for an improved therapeutic effect.

Figure 7:
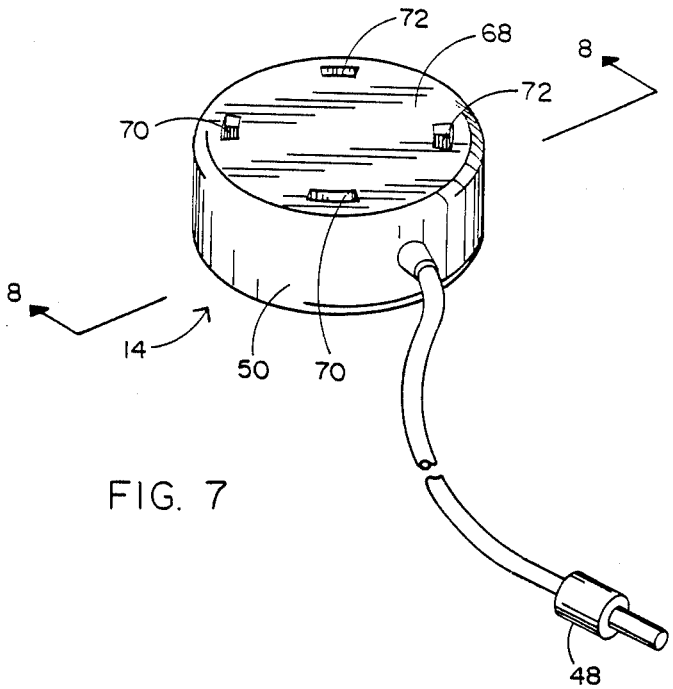
FIG. 7 is a perspective view of the vibratory unit shown upside down, i.e. with the base portion disposed upwardly.
Figure 8:
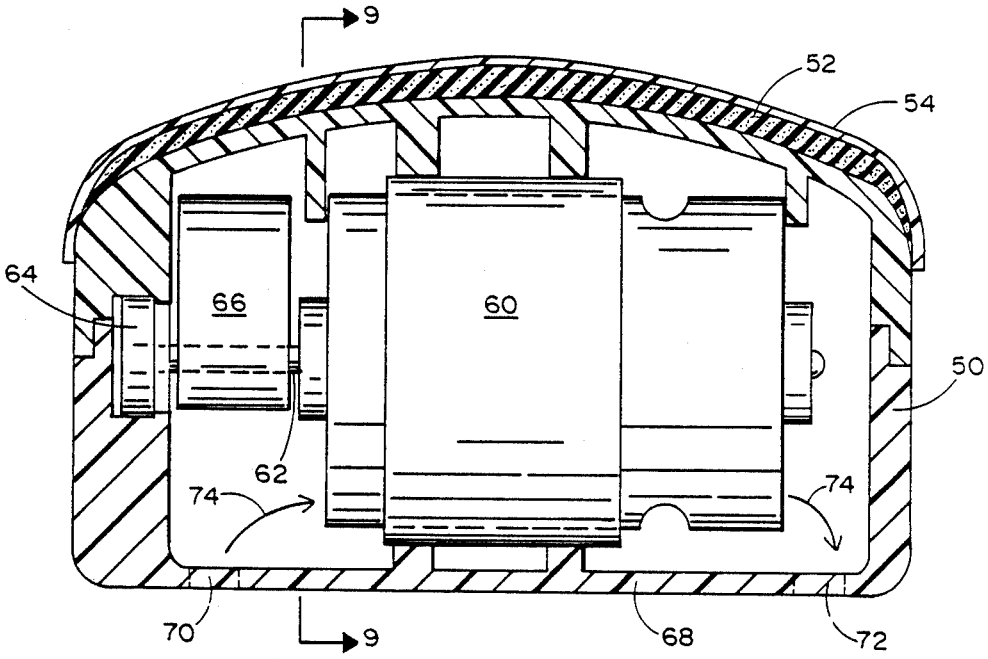
FIG. 8 is a section along line 8—8 of FIG. 7.
Figure 9:
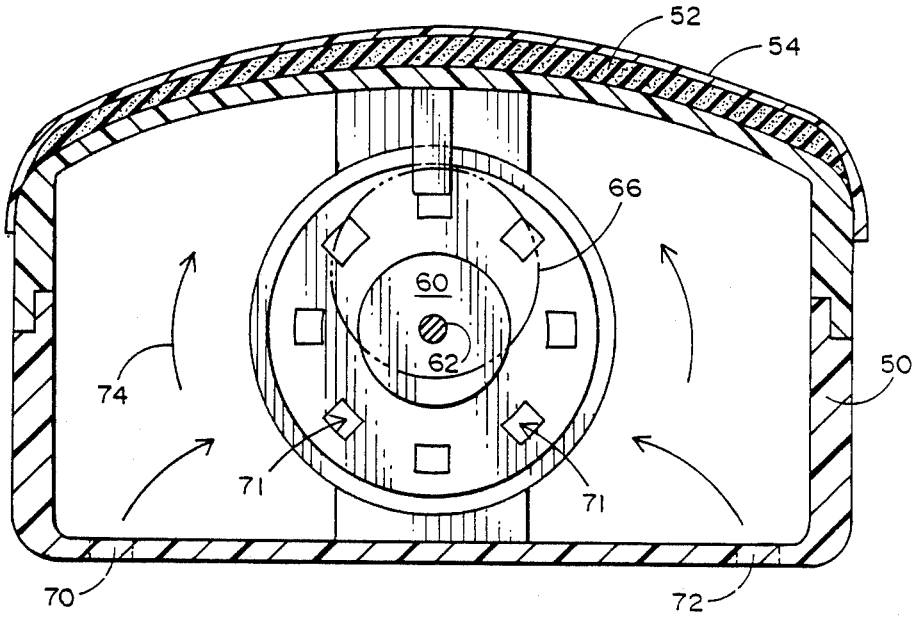
FIG. 9 is a section along line 9—9 of FIG. 8.

FIGS. 7 through 9 illustrate the details of a preferred embodiment of the vibrator unit 14 or 16. The vibrator unit 14 is equipped with an electric connector 48 and consists of a two-part casing 50 of high-impact styrene or the like, with a foam rubber buffer pad 52 covered by a thin, flexible cover 54 of a relatively smooth material such as polyvinyl chloride. The function of the buffer pad 52 is to reduce the harshness of the vibrations generated by the vibratory unit 14, and the function of the cover 54 is to prevent the buffer pad 52 from being eroded by frictional contact with the web 22. The smooth surface of cover 54 also assures that any creep will occur between the vibratory unit 14 and the web 22, and not between the web 22 and the patient's skin.

The Y connector 56 (FIG. 4) can receive the connector 48 of either or both of the vibrator units 14, 16, depending on the manner in which the device of this invention is used. The electrical connector 48 of each one of the vibrator units 14, 16 functions as first electrical connector means, and the Y connector 56 functions as second electrical connector means adapted to be positioned adjacent to the vibrating units to selectively receive the electrical connector 48 of each one of the vibrators 14, 16.

In order to produce a maximum amplitude of vibration with a motor 60 of minimum size, the shaft 62 of motor 60 is provided with a carrier bearing 64 mounted in the casing 50 (FIG. 8). The eccentric 66 which produces the vibrations is affixed to the shaft 62 between the motor 60 and the carrier bearing 64. The provision of the carrier bearing 64 greatly relieves the stress on shaft 62, and thus allows miniaturization of the motor 60 without shortening its life.

As best illustrated in FIG. 8, the base 68 of casing 50 is provided with air intake slots 70 disposed in alignment with the eccentric 66, and of a sufficient lateral extent so that they cannot be covered by the elastic band 32. The motion of the eccentric 66 causes a pumping action which forces air through the motor 60 via apertures 71 (FIG. 9) and out through the corresponding slots 72 in the casing base. This air flow, illustrated by the arrows 74, contributes to the cooling of motor 60 and allows it to be run at a higher speed without overheating than would normally be possible in the closed casing 50.

I claim:

1. A vibrating massage device, comprising:

(a) vibrator means for producing vibrations for purposes of massaging a human body part, said vibrator means including a casing having a top portion to be directed toward said human body part and a base portion against which to apply a force to hold said top portion against said human body part;

(b) belt means, including a substantially flexible, inelastic web adapted to be releasably attached around a particular human body part, for supporting said vibrator means with said top portion of said casing against said particular human body part, said web having thereon at least one vibrator location for the releasable attachment of said vibrator means thereto;

(c) an elastic band having a pair of longitudinal ends anchored to said web on longitudinally spaced apart opposite sides of the vibrator location for use in attaching said vibrator means to said web with the top portion of said casing disposed toward said web and the base disposed toward said elastic band;

(d) said elastic band having a size such that when said vibrator means is placed between said elastic band and said web with the web disposed generally flat, said elastic band stretches slightly over said base portion of the casing, and such that when said web is then placed around said particular human body part, said elastic band stretches more to press said top portion of said casing toward said particular human body part; and (e) retaining strap means associated with said belt means for releasably retaining said vibrator means against movement transversely of said belt means.

2. The device of claim 1, in which the length of said elastic band when distended is substantially equal to the longitudinal dimension of said vibrating means.

3. The device of claim 1, in which the material of said web is cotton.

4. The device of claim 1, wherein:

said top portion of said casing defines a substantially smooth surface adapted to lie against said web when said vibrating means is attached to said belt means.

5. A vibrating massage device as recited in claim 1, wherein the vibrator means includes:

(a) a motor fixedly mounted on said casing, said motor including a shaft;

(b) an eccentric mounted on said shaft for imparting vibration thereto when said shaft rotates; and (c) a carrier bearing fixedly mounted in said casing for rotatably supporting the end of said shaft remote from said motor.

6. A vibrating massage device as recited in claim 1, wherein the vibrator means includes:

(a) a motor fixedly mounted on said casing, said motor including a shaft;

(b) an eccentric mounted on said shaft for imparting vibration thereto when said shaft rotates; and (c) openings formed in said casing in alignment with said eccentric and also on the side of said motor opposite the side on which said eccentric is placed, whereby the motion of said eccentric causes cooling air to flow past said motor.

7. A vibrating massage device as recited in claim 1, wherein the vibrator means includes:

(a) a motor fixedly mounted on said casing, said motor including a shaft;

(b) an eccentric mounted on said shaft for imparting vibration thereto when said shaft rotates;

(c) a resilient buffer pad covering one outer surface of said casing; and (d) a thin, flexible, smooth-surfaced cover covering said buffer pad.

8. A vibrating massage device as recited in claim 1, wherein the vibrator means includes:

first electrical connector means.

9. A device as recited in claim 8, further comprising second electrical connector means adapted to be positioned adjacent said vibrator means and adapted to selectively receive said first electrical connector means of either one or a plurality of said vibrator means.

10. The device of claim 8, including a plurality of said belt means of varying size ranges for selectively attaching said vibrator means to different parts of the body.

11. A device as recited in claim 1, wherein said elastic band generally conforms to the shape of a portion of said vibrating means when said web is disposed in a generally flat position.

12. The device of claim 11, in which the length of said elastic band when distended is substantially equal to the longitudinal dimension of said vibrating means.

13. The device of claim 11, in which the material of said web is cotton.

14. The device of claim 11, in which the surface of said vibrating means which lies against said web when attached to said belt means is substantially smooth.

15. The device of claim 11, in which said device includes electrical conduit means for connecting said vibrator means to a source of power, said conduit means having control means interposed therein for controlling said vibrator means, said control means being so positioned along said conduit means as to be conveniently accessible to a person using said device during use of said device regardless of the position of said device on said person's body.

* * * * *